US007819583B2

(12) United States Patent
Walker et al.

(10) Patent No.: US 7,819,583 B2
(45) Date of Patent: Oct. 26, 2010

(54) BAG STRUCTURES AND METHODS OF ASSEMBLING THE SAME

(75) Inventors: Jeffrey L. Walker, Louisville, KY (US); Michael L. Iannelli, II, Pensacola, FL (US); Gary A. Fulk, Milton, FL (US)

(73) Assignee: Graphic Packaging International, Inc., Marietta, GA (US)

( * ) Notice: Subject to any disclaimer, the term of this patent is extended or adjusted under 35 U.S.C. 154(b) by 902 days.

(21) Appl. No.: 11/266,835

(22) Filed: Nov. 4, 2005

(65) Prior Publication Data

US 2007/0104397 A1 May 10, 2007

(51) Int. Cl.
*B65D 33/16* (2006.01)
*B65D 33/00* (2006.01)
*B65D 30/08* (2006.01)

(52) U.S. Cl. ..... 383/61.2; 383/205; 383/64; 383/109

(58) Field of Classification Search ..... 383/203, 383/61.1, 109, 89, 64, 61.2, 61.3, 5, 78, 83, 383/84, 85, 88, 204, 205, 206, 207, 209
See application file for complete search history.

(56) References Cited

U.S. PATENT DOCUMENTS 2,517,801 A * 8/1950 Roush ..... 229/87.05
3,810,813 A * 5/1974 Ellis ..... 428/172
4,471,875 A * 9/1984 Hain et al. ..... 383/211
4,620,320 A 10/1986 Sullivam
4,824,261 A * 4/1989 Provost ..... 383/204
4,902,142 A * 2/1990 Lammert et al. ..... 383/205
4,955,981 A * 9/1990 Provost ..... 383/206
5,048,692 A * 9/1991 Handler et al. ..... 383/203
5,725,312 A 3/1998 May
5,788,378 A 8/1998 Thomas
5,816,709 A * 10/1998 Demus ..... 383/61.2
5,938,337 A 8/1999 Provan et al.
5,964,532 A 10/1999 St. Phillips et al.
6,148,588 A 11/2000 Thomas et al.
6,273,607 B1 8/2001 Buchman
6,279,298 B1 8/2001 Thomas et al.
6,286,999 B1 9/2001 Cappel et al.
6,290,390 B1 9/2001 Buchman
6,290,391 B1 9/2001 Buchman
6,347,437 B2 2/2002 Provan et al.
6,347,885 B1 2/2002 Buchman
6,354,739 B1 * 3/2002 Sheehan et al. ..... 383/205
6,361,209 B1 3/2002 LaRue et al.
6,427,421 B1 8/2002 Belmont et al.

(Continued)

FOREIGN PATENT DOCUMENTS

EP 1132311 A2 * 9/2001

*Primary Examiner*—Jes F Pascua
(74) *Attorney, Agent, or Firm*—Womble Carlyle Sandridge & Rice, PLLC

(57) ABSTRACT

A bag structure includes a bag body including side walls having inner and outer surfaces, and the bag body further includes a top end and a bottom end. A closure member is coupled to the top end for opening and closing the bag body, and an adhesive member is secured to the bag body. The adhesive member includes a reinforced section and an adhesive section. The adhesive member is configured to retain the top end of the bag body in a folded over relationship until the adhesive member is severed along the reinforced section.

27 Claims, 5 Drawing Sheets

U.S. PATENT DOCUMENTS 6,439,770 B2 8/2002 Catchman
6,467,956 B1 10/2002 Tilman et al.
6,474,866 B2 11/2002 Buchman
6,499,878 B1 12/2002 Dobreski et al.
6,572,266 B2 6/2003 Buchman
6,575,625 B2 6/2003 Cappel et al.
6,609,828 B2 * 8/2003 Schneider et al. ..... 383/61.2
6,663,283 B1 12/2003 Cappel
6,712,509 B2 * 3/2004 Cappel ..... 383/61.2
6,719,140 B1 4/2004 Rinsel
6,802,879 B2 10/2004 Scanlon
6,805,485 B2 10/2004 Hogan et al.
6,846,107 B2 1/2005 Sweeney et al.
6,866,420 B2 3/2005 Buchman
6,974,256 B2 * 12/2005 Kinigakis et al. ..... 383/64
2002/0196987 A1 12/2002 Tilman
2003/0035598 A1 * 2/2003 Hiraiwa et al. ..... 383/205
2003/0138168 A1 7/2003 Petit
2004/0014579 A1 * 1/2004 Sweeney et al. ..... 493/394
2004/0091648 A1 5/2004 Hartzell et al.
2004/0114838 A1 6/2004 McGregor
2004/0223665 A1 * 11/2004 Blohowiak et al. ..... 383/89
2004/0228547 A1 * 11/2004 Hartzell et al. ..... 383/61.2
2005/0047686 A1 * 3/2005 Elsaesser ..... 383/204
2005/0111765 A1 * 5/2005 Beaulieu ..... 383/205
2006/0072859 A1 * 4/2006 Melchoir et al. ..... 383/203

* cited by examiner

BAG STRUCTURES AND METHODS OF ASSEMBLING THE SAME

BACKGROUND OF THE INVENTION

This invention relates generally to bag structures, and more particularly, to bag structures having improved loading and tamper evident features.

Bag structures may be fabricated from a single ply of material or from multiple plys or layers. The bag structures may be fabricated from paper or plastic materials. Typically, multiwall bags are fabricated as tubes formed from a plurality of paper plies. In addition to having paper plies, one or more plies, typically the innermost one or more plies, may be fabricated from a thin plastic material, or may be coated with a resinous material, to provide a degree of moisture resistance to the finished bag.

Closure of the multiwall bag structures are typically accomplished by applying adhesive (e.g., hot melt or sonically activatable adhesive) to the outer surface of the bag and folding over the top end. Closing the bag by simply folding and adhesively affixing the flap provides a pointed, pinch bottom closure. The opposite end of the bag may be likewise provided with a pinch bottom closure, or it may be closed and sealed in a different configuration, such as a diamond-or rectangular configuration, so that the pinch "bottom" may actually be the top of the bag, as may be found commonly in bags containing dry granular material, like dog food, cat litter or fertilizer. When such a bag is closed and sealed, the folded over closure is typically quite strong, and requires cutting of the bag plies below the folded over and sealed closure, in order to gain access to the contents of the bag. Moreover, once such bags are opened, the bags can not be reclosed or resealed. As such, the contents of the bag may spoil quickly or are susceptible to spillage through the opening.

In order to facilitate opening and closing of bag structures, such as flexible bags, some bag structures are known that incorporate a zipper that may be opened and closed. At least some of these known bag structures also include a slider to aide in opening and closing of the zipper. However, these known bag structures are typically included on flexible bags and bags that are top loaded. When a bag is top loaded, the product loaded into the bag does not contact the zipper during loading. As a result, the zipper is protected from any impact of loading the product into the bag. However, other known bag structures are bottom loaded, such as bags loaded with dry granular material, like dog food, cat litter or fertilizer. Because these bags are bottom loaded, the zipper at the mouth of the bag is susceptible to damage or rupture during loading of the product into the bag.

BRIEF DESCRIPTION OF THE INVENTION

In one aspect, a bag structure is provided including a bag body including side walls having inner and outer surfaces, and the bag body further includes a top end and a bottom end. A closure member is coupled to the top end for opening and closing the bag body, and an adhesive member is secured to the bag body. The adhesive member includes a reinforced section and an adhesive section. The adhesive member is configured to retain the top end of the bag body in a folded over relationship until the adhesive member is severed along the reinforced section.

In another aspect, a slider bag is provided including a bag body having a front wall, a rear wall, and side walls extending therebetween. The bag body has a top end and a bottom end, wherein the front, rear, and side walls extend between the top end and the bottom end. A zipper member is coupled to the front and rear walls at the top end of the bag body. The zipper member extends substantially an entire length of the bag body. A slider clip is coupled to the zipper member for opening and closing the zipper member, and an adhesive member extends along the zipper member. The adhesive member includes an adhesive section configured to secure the adhesive member to the bag body and a reinforced section extending substantially an entire length of the adhesive member. The adhesive member is secured to the bag body proximate the top end and is configured to retain the top end of the bag body in a folded over position until the adhesive member is severed.

In a further aspect, a method of assembling a bag structure is provided. The bag structure includes front, rear, and side walls extending between top and bottom ends of the bag structure. The bag structure also includes a zipper member, a slider clip, and an adhesive member having an adhesive section and a reinforced section. The method includes attaching the zipper member to the top end of the bag structure, and attaching the slider clip to the zipper member, wherein the slider clip is configured to open and close the zipper member. The method also includes folding over the top end of the bag structure along a fold line to define a top flap, and securing the top flap to an outer surface of the bag structure using the adhesive member, wherein the top flap is released upon severing the adhesive member at the reinforced section.

DETAILED DESCRIPTION OF THE INVENTION

Figure 1:
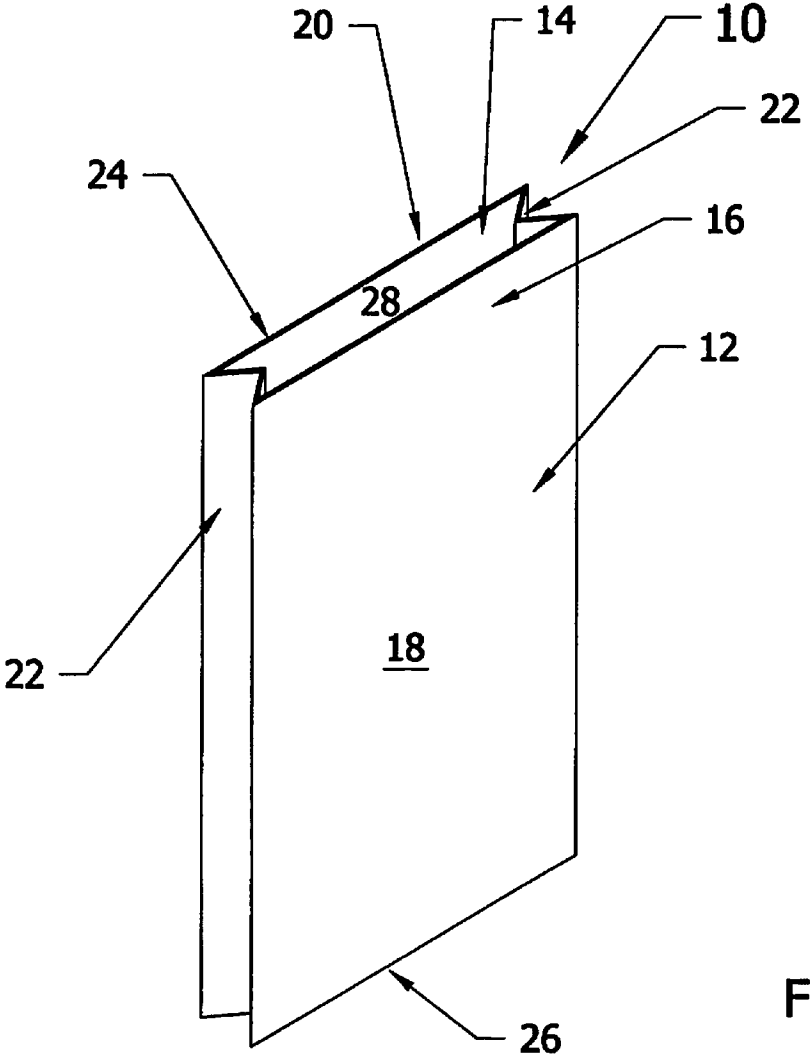
FIG. 1 is a top perspective view of a multiwall bag in an open position.

FIG. 1 is a top perspective view of a bag 10 in an open position. In an exemplary embodiment, bag 10 is constructed as a tubular body 12 formed from multiple layers or plies of material. For example, an inner layer 14 of bag 10 is a polymeric material and an outer layer 16 of bag 10 is a paper material. In the exemplary embodiment, bag 10 includes an inner plastic layer adhered to an inner paper member, and an outer paper member adhered to or otherwise secured to the inner paper member. However, bag 10 may include multiple layers of polymeric and/or paper materials along the inner or outer portions of bag 10. Alternatively, bag 10 is constructed of a single layer of paper or plastic material.

Bag 10 includes a front wall 18, a rear wall 20 and side walls 22. In the exemplary embodiment, side walls 22 are gusseted such that bag 10 may be folded flat. Bag 10 also includes a top end or mouth 24 and a bottom end 26. When formed, each of top and bottom ends 24 and 26 are open to a cavity 28. Cavity 28 is configured to receive a product (not shown). In the exemplary embodiment, bag 10 is bottom loaded such that the product is filled into cavity 28 through bottom end 26, and then bottom end 26 is sealed or otherwise closed.

Figure 2:
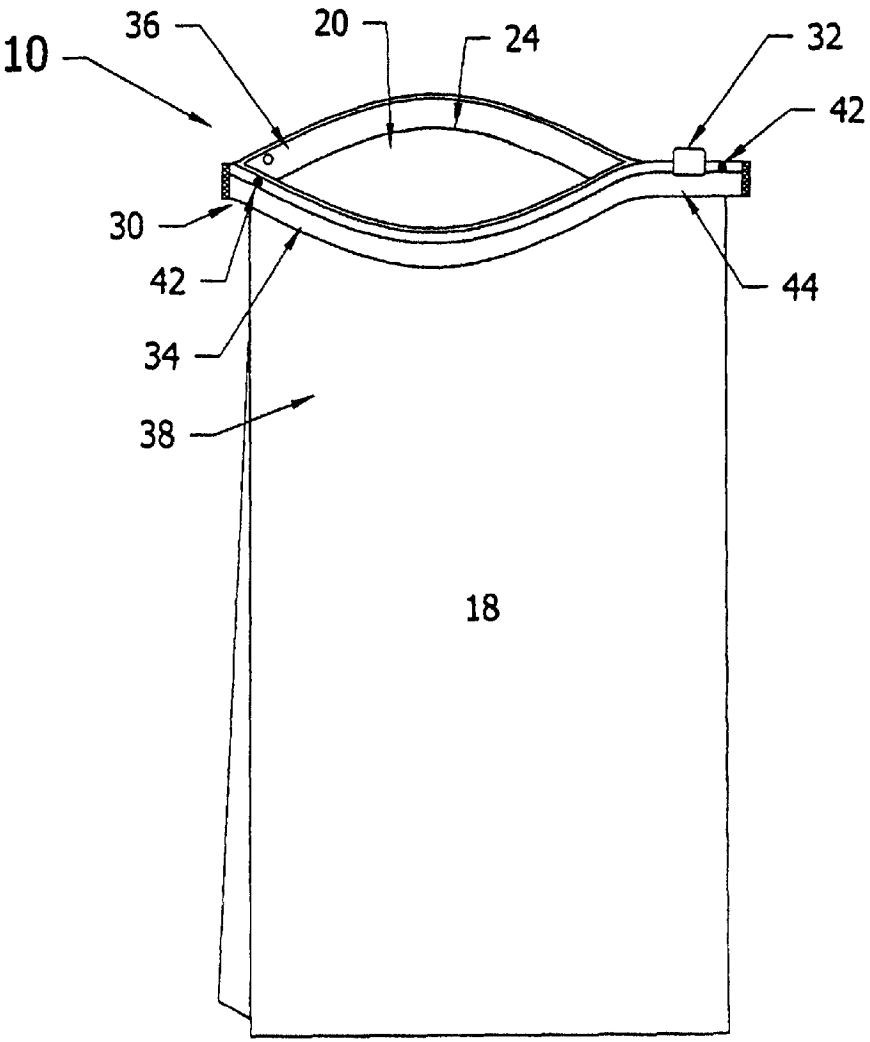
FIG. 2 is a top perspective view of the multiwall bag shown in FIG. 1 with a zipper member and slider clip attached thereto.

FIG. 2 is a top perspective view of bag 10 with a zipper member 30 and slider clip 32 attached thereto. Zipper member 30 includes first and second zipper profiles 34 and 36, respectively, coupled to top end 24 of bag 10. In one embodiment, each zipper profile 34 and 36 includes a track and an attachment flange extending from the track. The ends of the zipper member 30 are sealed to one another, such as by an ultrasonic sealing process. Zipper profiles 34 and 36 are releasably coupled to one another, and more particularly, the tracks of each zipper profile 34 and 36 are releasably coupled to one another. As such, bag 10 may be opened to access the product within bag 10 and closed again to restrict access to the product using zipper member 30. In the exemplary embodiment, zipper member 30 extends beyond the outer edges of front and rear walls 18 and 20. Alternatively, zipper member 30 extends for a length less than a width of front and rear walls 18 and 20. In the exemplary embodiment, zipper member 30 is opened and closed using slider clip 32.

First zipper profile 34 is attached to front wall 18, and more particularly, an outer surface 38 of front wall 18. Second zipper profile 36 is attached to rear wall 20, and more particularly, an outer surface 40 of rear wall 20. Alternatively, zipper profiles 34 and 36 are attached to inner surfaces of bag 10. In the exemplary embodiment, zipper profiles 34 and 36 are attached to bag 10 using an adhesive. Alternatively, zipper profiles 34 and 36 are attached to bag 10 using another securing means, such as, but not limited to, heat sealing or using a mechanical fastener.

In the exemplary embodiment, bag 10 includes a plurality of end stops 42 for limiting a range of motion of slider clip 32 along zipper member 30. End stops 42 extend outward from an outer portion 44 of zipper member 30. In one embodiment, end stops 42 extend outward from each of first and second zipper profiles 34 and 36. Additionally, end stops 42 are positioned proximate each end of zipper member 30. End stops 42 extend outward a distance to contact slider clip 32 as slider clip 32 is moved along zipper member 30. In the exemplary embodiment, end stops 42 are glue drops or glue beads which are applied to zipper member 30 during fabrication of bag 10.

Figure 3:
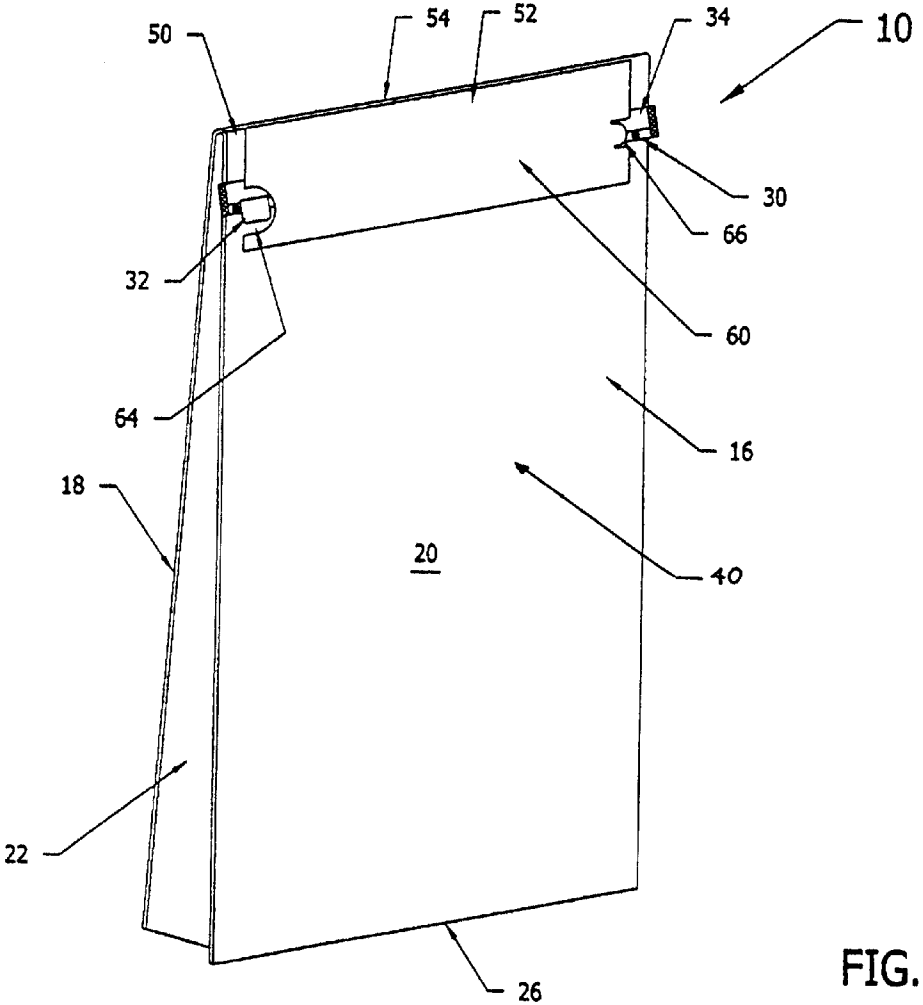
FIG. 3 is a top perspective view of the multiwall bag shown in FIG. 2 with a top portion of the bag folded over and an adhesive member affixed along the folded over portion.
Figure 4:
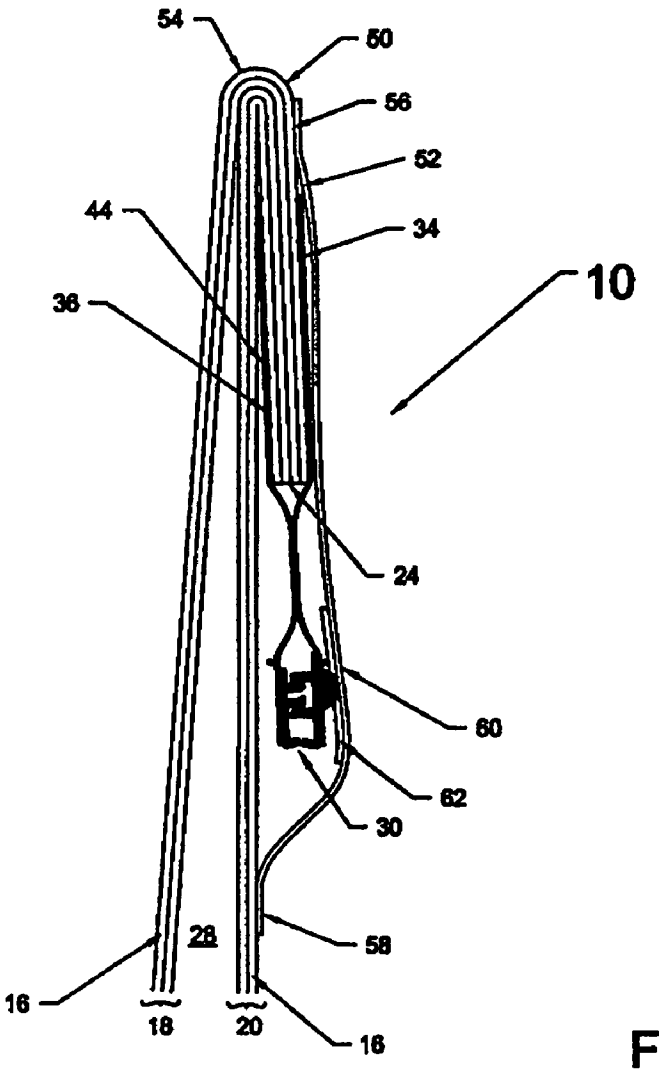
FIG. 4 is a cross sectional view of the multiwall bag shown in FIG. 3.

FIG. 3 is a top perspective view of bag 10 with a top portion or flap 50 of bag 10 folded over and secured using an adhesive member 52. FIG. 4 is a cross sectional view of bag 10 with top flap 50 folded over. During assembly, bag 10 is folded along a hinge or crease 54 to define top flap 50. Hinge 54 includes fold lines through each layer of material in bag 10 and is positioned proximate to top end 24 of bag 10 such that the overall volume of cavity 28 is as large as possible given the size of walls 18, 20 and 22. Additionally, hinge 54 is positioned a sufficient distance from top end 24 to provide an attachment area on bag 10 for adhesive member 52. As such, a strip of outer layer 16 of bag 10 is exposed between hinge 54 and zipper member 30, and adhesive member 52 is coupled to the strip of outer layer 16, as will be described in detail below. In the exemplary embodiment, when top flap 50 is folded over, rear wall 20 is folded over upon itself such that the portion of rear wall 20 defining top flap 50 contacts or is positioned proximate to rear wall 20. Additionally, when top flap 50 is folded over, outer portion 44 of second zipper profile 36 (i.e., the zipper profile coupled to rear wall 20) contacts or is positioned proximate to rear wall 20. Alternatively, when top flap 50 is folded over, front wall 18 is folded over upon itself and zipper profile 36 is positioned proximate front wall 18.

In assembly, when top flap 50 is folded over, top flap 50 and bag 10 define a false top at hinge 54. More particularly, during loading of bag 10 through bottom end 26, the product is loaded to fill cavity 28 to hinge 54. As such, the product is restricted from contacting top end 24 of bag 10, and more importantly, zipper member 30. As such, impact forces on zipper member 30 are reduced and/or eliminated during the filling process of bag 10.

In the exemplary embodiment, adhesive member 52 includes a first adhesive portion or band 56 and a second adhesive portion or band 58. First adhesive portion 56 secures adhesive member 52 to front wall 18 and/or first zipper profile 34. Second adhesive portion 58 secures adhesive member 52 to rear wall 20. As such, adhesive member 52 extends along first zipper profile 34 and secures top flap 50 in the folded over position. In the exemplary embodiment, adhesive member 52 is secured to bag 10 such that adhesive member 52 has a substantially flat or planar configuration. Specifically, adhesive member 52 extends along the contour of bag 10 from top flap 50 towards bottom end 26 of bag 10 and does not wrap around or fold over or under top end 24 of bag 10.

Moreover, in the exemplary embodiment, adhesive member 52 includes a reinforced section or tear strip 60. Reinforced section 60 extends between first and second adhesive portions 56 and 58, respectively. In the exemplary embodiment, reinforced section 60 includes an area of reinforcement extending between first and second adhesive portions 56 and 58. In one embodiment, reinforced section 60 is reinforced with a plastic band 62 extending the length of reinforced section 60 to contact the zipper member 30, as shown in FIG. 4. In one embodiment, reinforced section 60 extends substantially the entire length of adhesive member 52. In another embodiment, adhesive member 52 includes a notched out portion 64 at an edge of adhesive member 52 and aligned with reinforced section 60. In the exemplary embodiment, slider clip 32 is positioned within notched out portion 64 and is restricted from moving along zipper member 30 until reinforced section 60 is removed.

In use, severing of adhesive member 52 releases top flap 50 and allows access to zipper member 30 and the contents of bag 10. Specifically, severing of adhesive member 52 may be accomplished by removing reinforced section 60. Additionally, removal of reinforced section 60 allows slider clip 32 to move along zipper member 30. In the exemplary embodiment, adhesive member 52 includes a pull tab 66 connected to one end of reinforced section 60. Pull tab 66 facilitates severing of reinforced section 60 along the area of reinforcement. Specifically, pull tab 66 is configured to separate at least a portion of reinforced section 60 from first and second adhesive portions 56 and 58.

Figure 5:
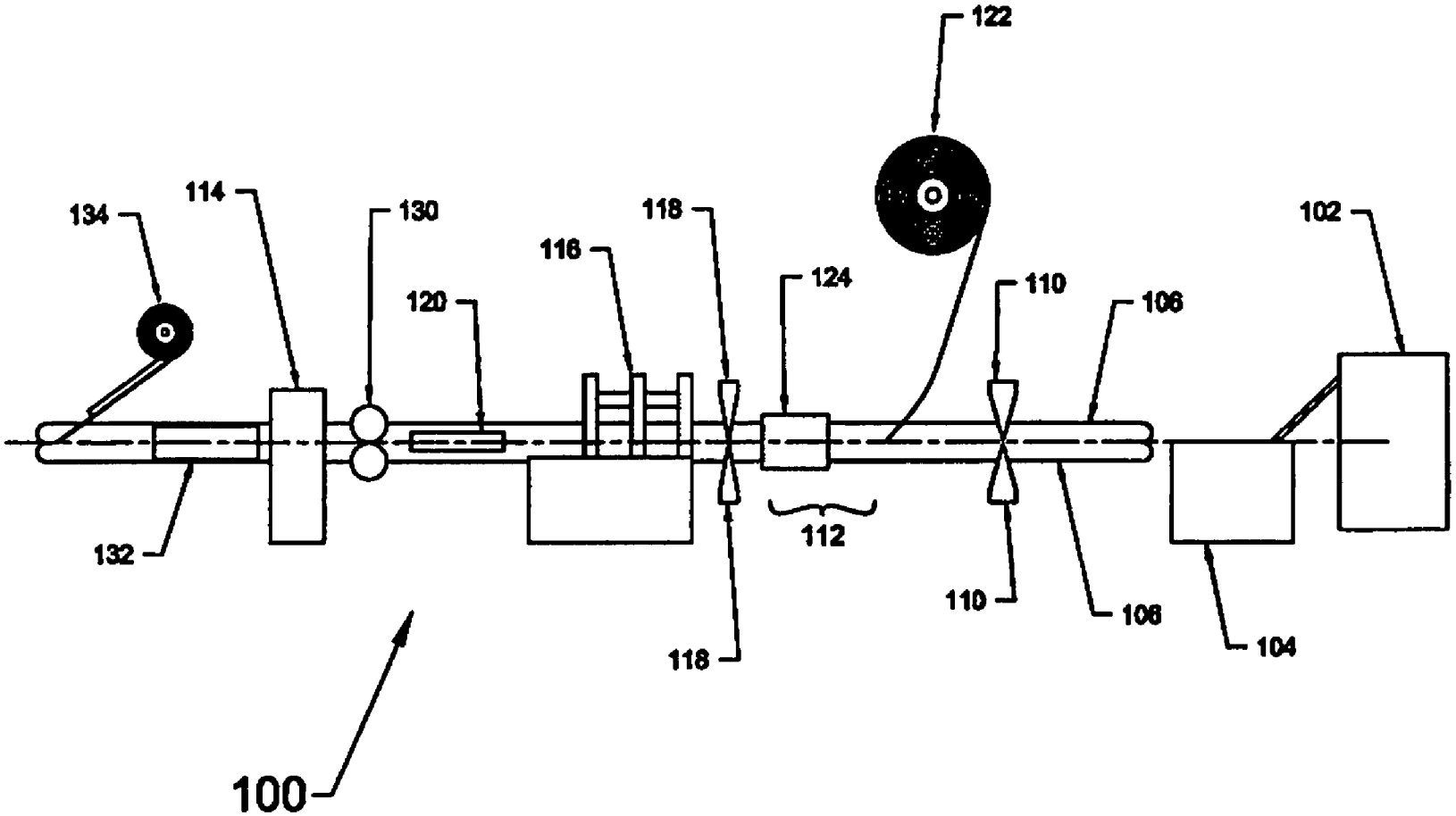
FIG. 5 is a schematic view of a forming machine that may be used to manufacture the multiwall bag shown in FIGS. 1-4.

FIG. 5 is a schematic view of a forming machine 100 that may be used to form bag 10 (shown in FIGS. 1-4). Forming machine 100 includes a plurality of components used to form bag 10. In one embodiment, the components are generally grouped into three forming phases, a positioning or set-up phase; a zipper/slider application or intermediate phase; and a folding or finishing phase.

In the exemplary embodiment, forming machine 100 includes a bag feeder 102, a registration table 104, and transporting members 106. Components 102, 104 and 106 are utilized in the positioning phase. Specifically, bag feeder 102 houses multiple, preformed tubular multiwall bags 10. Feeder 102 feeds individual bags 10 onto registration table 104. Registration table 104 aligns and positions bags 10 squarely and consistently as bags 10 are transferred downstream to the remaining components of forming machine 100. Specifically, registration table 104 aligns each bag 10 parallel to each other bag 10 and aligns top ends 24 (shown in FIG. 1) of bags 10. As such, top ends 24 of bags 10 are positioned to receive zipper members 30 (shown in FIG. 2). As bags 10 are accepted onto registration table 104, bags 10 are consistently spaced from a trailing edge of one bag 10 to a leading edge of another bag 10 (i.e., a consistent spacing between side walls 22 of adjacent bags 10). Additionally, transporting members 106 cooperate with registration table 104 for aligning, securing and transporting bags 10 and maintaining the relative positions of bags 10. In one embodiment, transporting members 106 include belts, such as conveyor type belts, that are positioned on opposing sides of and engaging bags 10, thus securing bags 10 therebetween. Also, transporting members 106 facilitate transferring bags 10 downstream to the remaining components of forming machine 100.

Moreover, in the exemplary embodiment, forming machine 100 includes a first adhesive applicator 110, a slider applicator system 112, and a cutter 114. In one embodiment, forming machine also includes a zipper member sealing system 116, a second adhesive applicator 118, and a venturi 120. Components 110-120 are utilized in the zipper/slider application phase.

Bags 10 are transferred to first adhesive applicator 110 by transporting members 106. As bags 10 are transferred past applicator 110, adhesive is applied to bag 10. In one embodiment, adhesive is applied to front and rear walls 18 and 20 (shown in FIG. 1) proximate top end 24 of bag 10. In one embodiment, adhesive is applied as a continuous bead. In another embodiment, adhesive is applied as individual bead drops. Bags 10 are then transferred to slider applicator system 112.

Slider applicator system 112 includes a zipper applicator 122 and a slider applicator 124. Zipper applicator 122 attaches zipper member 30 to bags 10, and slider applicator 124 attaches slider clips 32 to zipper member 30. Alternatively, slider clips 32 are attached to zipper member 30 and the zipper/slider combination is attached as a unit to bags 10. In the exemplary embodiment, zipper member 30 is attached as a continuous web to bags 10 as bags 10 are transferred past slider applicator system 112. In one embodiment, the flanges of first and second zipper profiles 34 and 36 are adhered or otherwise secured to the adhesive beads applied to bags 10 by first adhesive applicator 110. Alternatively, the adhesive beads are applied directly to zipper member 30 prior to joining zipper member 30 to bag 10. In another alternative embodiment, zipper member 30 includes a hot melt portion such that zipper member 30 is attached to bag 10 upon application of heat to zipper member 30. In the exemplary embodiment, after zipper member 30 is attached to bags 10, slider clip 32 is coupled to the tracks of zipper member 30.

In one embodiment, bags 10 are transferred from slider applicator system 112 to zipper member sealing system 116. Sealing system 116 seals the flanges of first and second zipper profiles 34 and 36 to one another to form end portions of zipper member 30. In one embodiment, sealing system 116 is an ultrasonic sealer. In one embodiment, sealing system 116 includes an actuator (not shown) configured to move multiple sealing units with bags 10. As a result, multiple bags 10 may be sealed simultaneously.

In one embodiment, bags 10 are transferred from slider applicator system 112 to second adhesive applicator 118. Second adhesive applicator 118 applies beads of adhesive to the outer portion of first and second zipper profiles 34 and 36. As such, the beads of adhesive, or glue drops, function as end stops for slider clip 32. Additionally, in one embodiment, forming machine 100 includes venturi 120. Venturi 120 directs airflow to the glue drops to facilitate quick cooling of the glue drops as bags 10 are transferred downstream. In an alternative embodiment, rather than second adhesive applicator 118, forming machine includes an alternative end stop applicator.

In the exemplary embodiment, bags 10 are transferred downstream of slider applicator system 112 to cutter 114. As indicated above, zipper member 30 is applied to bags 10 as a continuous web. As such, zipper member 30 extends between and connects the individual bags 10 to one another. Cutter 114 facilitates cutting zipper member 30 between bags 10 such that bags 10 are no longer connected to one another.

Moreover, in the exemplary embodiment, forming machine 100 includes a creasing member 130, a folding station 132, and an adhesive member applicator 134. Components 130-134 are utilized in the folding phase. In the exemplary embodiment, creasing member 130 includes a wheel having a wedge shaped edge. Creasing member 130 forms fold lines in bag 10 which ultimately define hinge 54 (shown in FIG. 3). In one embodiment, creasing member 130 is utilized to crease bags 10 prior to bags 10 being cut by cutter 114.

Bags are transferred from creasing member 130 to folding station 132. At folding station 132, top flap 50 (shown in FIG. 3) is folded over at hinge 54 created by creasing member 130. In one embodiment, folding station 132 includes a plurality of rails that engage top flap 50 of bag 10 and fold top flap about hinge 54. The rails also secure top flap 50 in a folded over position as bags 10 are transferred to adhesive member applicator 134.

Adhesive member applicator 134 houses a web of adhesive members 52. As bags 10 are transferred past adhesive member applicator 134, the individual adhesive members 52 are attached to bags 10 proximate top flap 50. Specifically, adhesive members 52 are attached to both front and rear walls 18 and 20 of bag 10 and extend along first zipper profile 34 (shown in FIG. 3). As a result, adhesive members 52 secure top flaps 50 in the folded over position.

As a result, a multiwall bag and a machine for forming the multiwall bag are provided. The multiwall bag includes a zipper member and a slider for opening and closing the zipper member. The multiwall bag is configured for bottom loading of a product, and during loading, the top end of the multiwall bag is subject to impact forces. As a result, the multiwall bag is designed such that the top end of the bag is folded over. An adhesive member is attached to the top flap to retain the top flap in a folded over position. The adhesive member extends along one side of the zipper profile and is secured to both the front and rear walls. When the adhesive member is applied and the top flap is folded over, the impact forces from loading of the multiwall bag are substantially reduced and/or eliminated. To access the contents of the multiwall bag, a reinforced section extending through the adhesive member is removed and adhesive member is severed. Additionally, the adhesive member functions as a tamper evident member. As a result, an improved multiwall bag is provided in a cost effective and reliable manner.

Exemplary embodiments of a multiwall bag are described above in detail. The bag is not limited to the specific embodiments described herein, but rather, components of each bag may be utilized independently and separately from other components described herein. Each bag component can also be used in combination with other bag components.

While the invention has been described in terms of various specific embodiments, those skilled in the art will recognize that the invention can be practiced with modification within the spirit and scope of the claims.

What is claimed is:

1. A bag structure for holding a product, the bag structure comprising:

a bag body comprising side walls having inner and outer surfaces, said body further comprising a top end and a bottom end, the bottom end being adapted for loading the product into the bag structure;

a closure member coupled to said top end for opening and closing said bag body, the closure member having a closure end that is spaced apart from the top end of the body, said closure end comprising an edge of said closure member, the edge being free from direct connection to said bag body and extending generally parallel to said top end of said bag body; and an adhesive member secured to said outer surfaces of said bag body and comprising a reinforced section and an adhesive section, said reinforced section comprising a first edge and a second edge that are each generally parallel to said top end of said bag body, said reinforced section configured to contact said closure end with the first edge of said reinforced section situated between said top end of said bag body and the edge of said closure member and the second edge of said reinforced section situated between the edge of said closure member and said bottom end of said bag body when said bag body is folded over, and said adhesive member configured to retain said top end of said bag body in a folded over relationship until said adhesive member is severed along said reinforced section, wherein, when the product is loaded into the bag structure, impact forces from loading the product through the bottom end are exerted on the bag body.

2. A bag structure in accordance with claim 1 wherein said adhesive member extends substantially an entire length of said top end of said bag body.

3. A bag structure in accordance with claim 1 wherein said adhesive section comprises a first adhesive portion and a second adhesive portion, said first adhesive portion secured to a first said side wall of said bag, said second adhesive portion secured to a second said side wall of said bag, said second side wall generally opposed to said first side wall.

4. The bag structure of claim 3 wherein the reinforced section comprises a layer of material positioned on the inside surface of the adhesive member, and the layer of material is positioned between the first adhesive section and the second adhesive section for contact with the closure member.

5. The bag structure of claim 4 wherein the layer of material comprises a plastic band extending substantially the entire length of the reinforced member.

6. The bag structure of claim 4 wherein the adhesive member comprises a notched out portion at an edge of the adhesive member and aligned with the reinforced section.

7. The bag structure of claim 6 wherein the closure member comprises a slider clip positioned within the notched out portion and restricted from moving along the closure member by the layer of material of the reinforced section.

8. The bag structure of claim 4 wherein the reinforced section comprises a pull tab for facilitating severing of the layer of material at the closure end.

9. A bag structure in accordance with claim 1 wherein said reinforced section comprises a pull tab configured to separate at least a portion of said reinforced section from said adhesive section.

10. A bag structure in accordance with claim 1 wherein said side walls comprise a front wall and an opposed rear wall, said closure member attached to said front and rear walls, said bag body configured such that when said top end of said bag body is folded over an outer portion of said closure member attached to said rear wall abuts said outer surface of said rear wall a distance from said top end of said bag body, wherein said adhesive member extends along an outer portion of said closure member attached to said front wall.

11. A bag structure in accordance with claim 1 wherein said bag body comprises at least one outer layer of paper material and at least one inner layer of polymeric material.

12. A bag structure in accordance with claim 1 wherein said closure member comprises a zipper member attached to said top end of said bag body and a slider clip for opening and closing said zipper member.

13. A bag structure in accordance with claim 1 further comprising first and second end stops extending outwardly from said closure member proximate outer edges of said closure member, said closure member comprising a slider clip moveable between said end stops.

14. A bag structure in accordance with claim 13 wherein said end stops comprise glue drops secured to an outer portion of said closure member.

15. The bag structure of claim 1 wherein the closure member comprises at least one zipper profile and the reinforced section contacts an end of the at least one zipper profile.

16. The bag structure of claim 15 wherein the reinforced section comprises a tear strip.

17. The bag structure of claim 1 wherein the reinforced section comprises a tear strip comprising a plastic band that is in contact with the closure end.

18. The bag structure of claim 17 wherein the closure member comprises at least one zipper profile comprising at least one of a track and an attachment flange at the closure end.

19. A slider bag for holding a product, the slider bag comprising:

a bag body comprising a front wall, a rear wall, and side walls extending therebetween, said bag body having a top end and a bottom end, said front, rear, and side walls extending between said top end and said bottom end, the bottom end being adapted for loading the product into the bag body;

a zipper member coupled to said front and rear walls at said top end of said bag body, said zipper member extending substantially an entire length of said top end of said bag body, said zipper member comprising an edge that is free from direct connection to said bag body and that extends generally parallel to said top end of said bag body;

a slider clip coupled to a closure end of said zipper member for opening and closing said zipper member; and an adhesive member extending along said zipper member and comprising an adhesive section configured to secure said adhesive member to said bag body and a reinforced section extending substantially an entire length of said adhesive member, said adhesive member secured to outer surfaces of said bag body proximate said top end and configured to retain said top end of said bag body in a folded over position until said adhesive member is severed, said reinforced section comprising a first edge and a second edge that are each generally parallel to said top end of said bag body, said reinforced section configured to contact the closure end of said zipper member with the first edge of said reinforced section situated between said top end of said bag body and the edge of said zipper member and the second edge of said reinforced section situated between the edge of said zipper member and said bottom end of said bag body when said bag body is folded over, wherein, when the product is loaded into the bag structure, impact forces from loading the product through the bottom end are exerted on the bag body.

20. A slider bag in accordance with claim 19 wherein said adhesive section comprises a first adhesive portion secured to said front wall and a second adhesive portion secured to said rear wall such that said adhesive member has a substantially flat configuration.

21. A slider bag in accordance with claim 19 wherein said reinforced section comprises a pull tab for severing said adhesive member along said reinforced section.

22. A slider bag in accordance with claim 19 wherein an outer portion of said zipper member attached to said rear wall abuts said outer surface of said rear wall a distance from said top end when said top end is folded over, and said adhesive member extends along an outer portion of said zipper member attached to said front wall when said top end is folded over.

23. A slider bag in accordance with claim 19 wherein said front, rear, and side walls comprise complementary fold lines extending substantially parallel to and spaced apart from said top end to define a top flap, said top flap configured to be folded over, said top flap defines a false top for said bag such that when said bag is bottom loaded with a product, the product contacts the false top defined by said fold lines during loading of the product and said top flap restricts the product from contacting said top end of said bag until said adhesive member is severed.

24. A slider bag in accordance with claim 19 further comprising first and second end stops extending outwardly from said zipper member proximate outer edges of said zipper member, said slider clip moveable between said end stops.

25. A slider bag in accordance with claim 24 wherein said end stops comprise glue drops secured to an outer portion of said zipper member.

26. The slider bag of claim 19 wherein the reinforced section comprises a tear strip comprising a plastic band that is in contact with the closure end.

27. The bag structure of claim 26 wherein the zipper member comprises at least one zipper profile comprising at least one of a track and an attachment flange at the closure end.

* * * * *